US008794511B2

(12) United States Patent
Siemens et al.

(10) Patent No.: US 8,794,511 B2
(45) Date of Patent: Aug. 5, 2014

(54) DROP SAFE SYSTEM

(75) Inventors: John R. Siemens, Consecon (CA); Jason B. Siemens, Beeton (CA)

(73) Assignee: Armor Safe Technologies, LLC, The Colony, TX (US)

( * ) Notice: Subject to any disclaimer, the term of this patent is extended or adjusted under 35 U.S.C. 154(b) by 32 days.

(21) Appl. No.: 13/442,308

(22) Filed: Apr. 9, 2012

(65) Prior Publication Data

US 2013/0264387 A1 Oct. 10, 2013

(51) Int. Cl.
*G07D 11/00* (2006.01)

(52) U.S. Cl.
USPC ..... 235/379

(58) Field of Classification Search
USPC ..... 235/379; 340/521
See application file for complete search history.

(56) References Cited

U.S. PATENT DOCUMENTS

| | | | | |
|---|---|---|---|---|
| 5,538,122 | A | 7/1996 | Siemens | |
| 5,725,081 | A | 3/1998 | Meeker | |
| 5,742,034 | A | 4/1998 | Meeker | |
| 5,883,371 | A | 3/1999 | Meeker | |
| 6,659,340 | B2 * | 12/2003 | Siemens | 235/379 |
| 6,792,334 | B2 * | 9/2004 | Metcalf et al. | 700/237 |
| 7,111,754 | B1 | 9/2006 | Siemens | |
| 7,819,308 | B2 * | 10/2010 | Osterberg et al. | 235/379 |
| 2004/0201472 | A1 * | 10/2004 | McGunn et al. | 340/521 |

FOREIGN PATENT DOCUMENTS

| | | |
|---|---|---|
| CA | 2095991 | 11/1994 |
| CA | 2312275 | 12/2001 |
| CA | 2717280 | 4/2012 |

OTHER PUBLICATIONS

Mars Bill Acceptor, Installation/Operation Guide. Mars Incorporated, 1998.

* cited by examiner

*Primary Examiner* — Daniel Hess
(74) *Attorney, Agent, or Firm* — Greer Burns & Crain Ltd.

(57) ABSTRACT

A drop safe comprising a vault, a computing means within the vault, at least one bill validator, a code reader, and a currency compartment. The computing means is connected to the bill validator and a code reader. The currency compartment receives and stores paper currency from the bill validator. The computing means, initially in idle mode, switches to deposit mode when the code reader detects a deposit initiation code. While in the deposit mode, the computing means monitors the bill validator and the code reader for detection of a deposit of paper currency, deposit termination code, and a time-out condition. The deposit mode terminates when a deposit termination code or a time-out condition is detected, in which case the computing means switches back to idle mode. Methods of depositing cash into the drop safe, and removing cash the drop safe are also disclosed.

39 Claims, 11 Drawing Sheets

DROP SAFE SYSTEM

FIELD OF THE INVENTION

The present invention relates generally to computerized drop safes. More particularly, the present invention relates to a drop safe adapted to track deposits and withdrawals of cash into and out of the drop safe.

BACKGROUND OF THE INVENTION

Business establishments such as convenience stores, and restaurants, for example, typically handle large amounts of cash, particularly in the form of paper money, on a daily basis. To reduce risk of the cash being stolen by robbers, these establishments tend to maintain only a minimal amount of cash in a cash register, and periodically transfer accumulated cash to an on-site safe or drop safe. A drop safe is preferred because it permits cashiers to deposit cash into the drop safe without giving the cashiers access to the contents of the drop safe. The drop safe is typically fitted with a slot into which the cash is either directly deposited, or the cash is first placed into an envelope before it is placed into the slot. In either case the cash is deposited into the drop safe without having to open the drop safe. Transferring the accumulated cash to the drop safe several times in a day reduces the amount of money present at a cash register, thereby reducing the potential exposure of the cash to loss due to robbery.

Some drop safes include electronic bill validation which allows the drop safes to not only receive cash deposits but to also provide some form of automation for reconciliation before the safe is opened by a security company or other intermediaries.

Larger business establishments typically rely on a security company or other intermediary to withdraw the cash deposited in their drop safes at the end of the day or week and transfer it to a bank for safekeeping.

To help business establishments track the cash deposits into and out from the drop safe, electronic drop safes have been designed with bill counting and validation capabilities, in addition to information recording capabilities for tracking specifics of deposits and withdrawals, maintenance/service issues etc., and information networking capabilities for relaying the information off site.

Although advances in electronic drop safes have lead to increased capabilities and features, they unfortunately come at an increased cost. Typically, the advances in electronic drop safes require integrated screens, buttons, and key pads to function. The screens display information, feature rich menus, and command prompts to users, while the buttons and key pads register user selections, instructions, and commands. However, screens, buttons, and keypads increase the cost of electronic drop safes due to the additional hardware, the additional complexity of integrating the additional hardware, and the additional complexity of the software needed to operate the additional hardware. The additional hardware is also prone to failure which requires expensive repairs.

SUMMARY OF THE INVENTION

What is desired is to provide an electronic drop safe having the advantages of a conventional electronic drop safe but at a reduced cost by departing from the conventional screens, buttons, and keypads. Providing the same or substantially the same functionality of conventional electronic drop safes without the use of screens, buttons, and keypads requires a novel approach to prompting the user and to registering the user's instructions and commands.

Therefore, there is provided according to one aspect of the present invention a drop safe comprising:

a vault;

a computing means located inside said vault, said computing means being operatively connected to at least one bill validator for reading paper currency, and a code reader for reading codes;

a currency compartment located inside said vault for storing paper currency, said currency compartment being in communication with said bill validator;

said bill validator having a means for validating, and determining a denomination of, paper currency; and said computing means initially being in an idle mode and configured to switch between said idle mode and a deposit taking mode;

wherein, upon said code reader detecting a deposit initiation code, the computing means switches from said idle mode to said deposit taking mode, and upon said code reader detecting a deposit termination code, the computing means switches from said deposit taking mode back to said idle mode.

According to another aspect of the present invention there is provided a method of depositing cash into a drop safe having a vault, a currency compartment, at least one bill validator for reading said paper currency, said bill validator having means for transferring paper currency to said currency compartment, a code reader for reading codes, and a computing means operatively connected to said bill validator and said code reader, said method comprising the steps of:

(i) initiating a deposit taking mode by presenting a deposit initiation code to said code reader, said code reader detecting and transmitting the deposit initiation code to said computing means;

(ii) maintaining said deposit taking mode by inserting a paper currency into said bill validator for transfer to said currency compartment, if accepted by said computing means; and (iii) ending said deposit taking mode by:

(a) presenting a deposit termination code to said code reader; or (b) allowing a predetermined amount of time to elapse after said maintaining step.

According to yet another aspect of the present invention there is provided a method of removing cash from a drop safe having a vault with a vault door securable by an electronic lock, a currency compartment, at least one bill validator with means to transfer paper currency from an input end thereof to said currency compartment, the bill validator being configured to read said paper currency, code reader for reading codes, and a computing means operatively connected to said bill validator, and said code reader, said method comprising the steps of:

providing pickup request information to a remote computer, said remote computer being wiredly or wirelessly linked to said computing means;

when prompted by said remote computer, presenting a code representing at least one piece of said pickup request information to said code reader, said code reader detecting and transmitting said pickup request information code to said computing means;

allowing said remote computer to validate the pickup request information code, in which case the remote computer sends a signal to the computing means to deactivate the electronic lock;

opening said vault door when said electronic lock is deactivated by said computing means in response to the signal from the remote computer; and removing said paper currency from said currency compartment.

BRIEF DESCRIPTION OF THE DRAWINGS

Reference will now be made to the preferred embodiments of the present invention with reference, by way of example only, to the following drawings in which.

DETAILED DESCRIPTION OF THE PREFERRED EMBODIMENTS

The present invention is described in more detail with reference to exemplary embodiments thereof as shown in the appended drawings. While the present invention is described below including preferred embodiments, it should be understood that the present invention is not limited thereto. Those of ordinary skill in the art having access to the teachings herein will recognize additional implementations, modifications, and embodiments which are within the scope of the present invention as disclosed and claimed herein. In the figures, like elements are given like reference numbers. For the purposes of clarity, not every component is labelled in every figure, nor is every component of each embodiment of the invention shown where illustration is not necessary to allow those of ordinary skill in the art to understand the invention.

Figure 1:
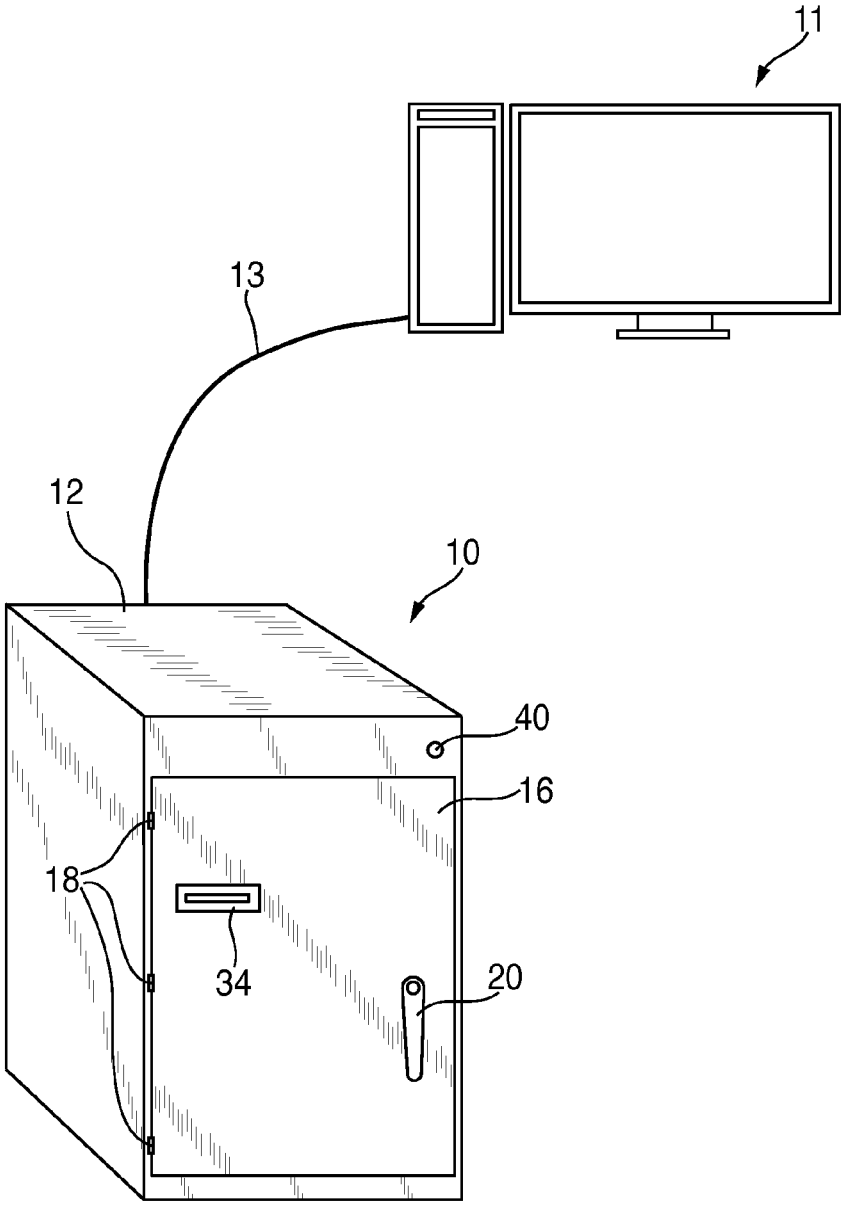
FIG. 1 is perspective view of a drop safe according to an embodiment of the present invention with a vault and a vault door in a closed configuration.
Figure 2:
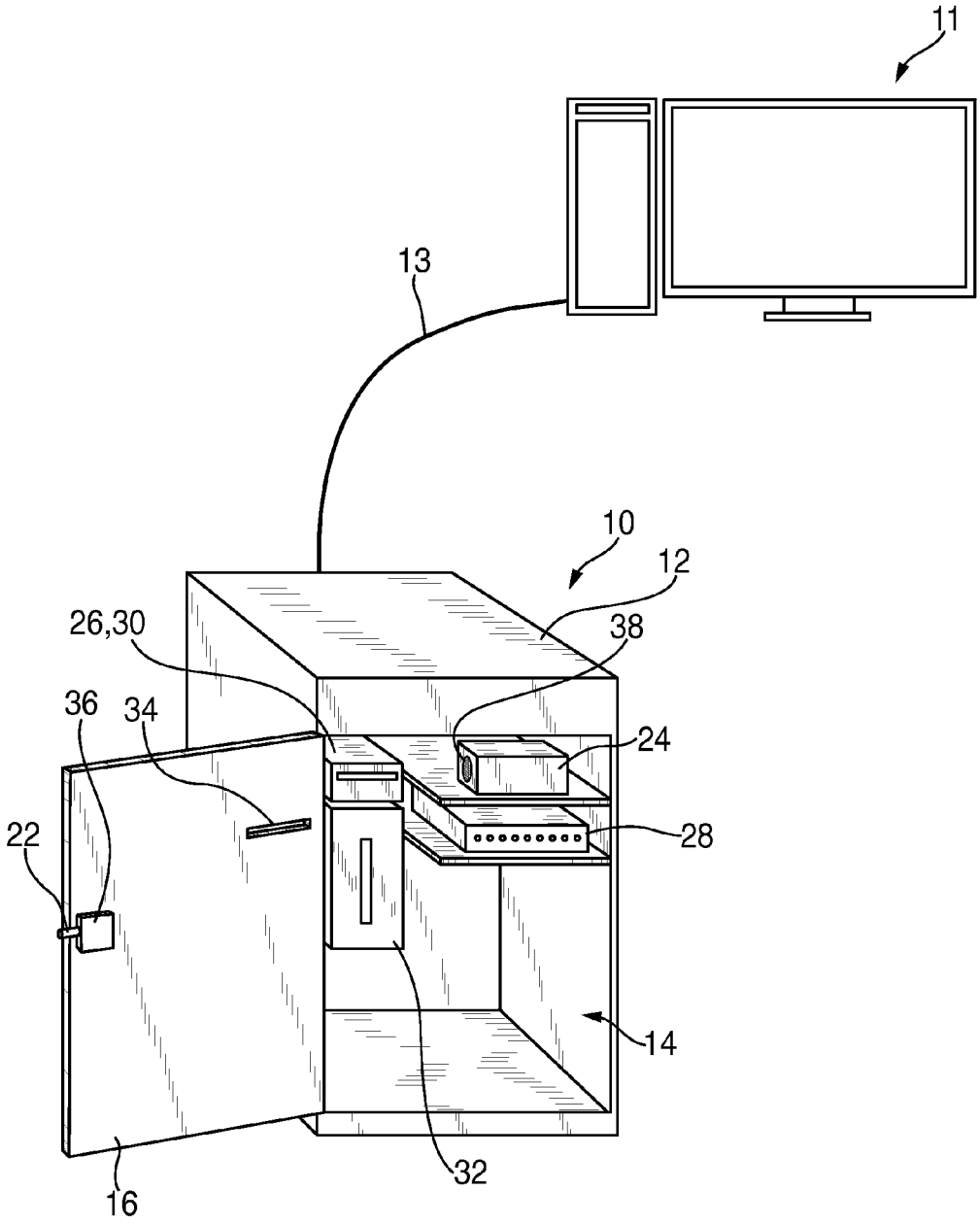
FIG. 2 is a perspective view of the drop safe of FIG. 1 with the vault door in an open configuration.

With reference to FIGS. 1 and 2, there is shown a drop safe 10 according to an embodiment of the present invention. The drop safe 10 has a vault 12 enclosing an interior chamber 14. A door 16 is attached to the vault 12 via hinges 18. The interior chamber 14 is selectively accessible when the vault door 16 is in an open position as shown in FIG. 2. In FIG. 1 the door 16 is shown in a closed position. The door 16 is fitted with a handle 20 which facilitates opening and closing of the door 16. The handle 20 also operates a bolt 20 for securing the door 16 in the closed configuration.

Figure 3:
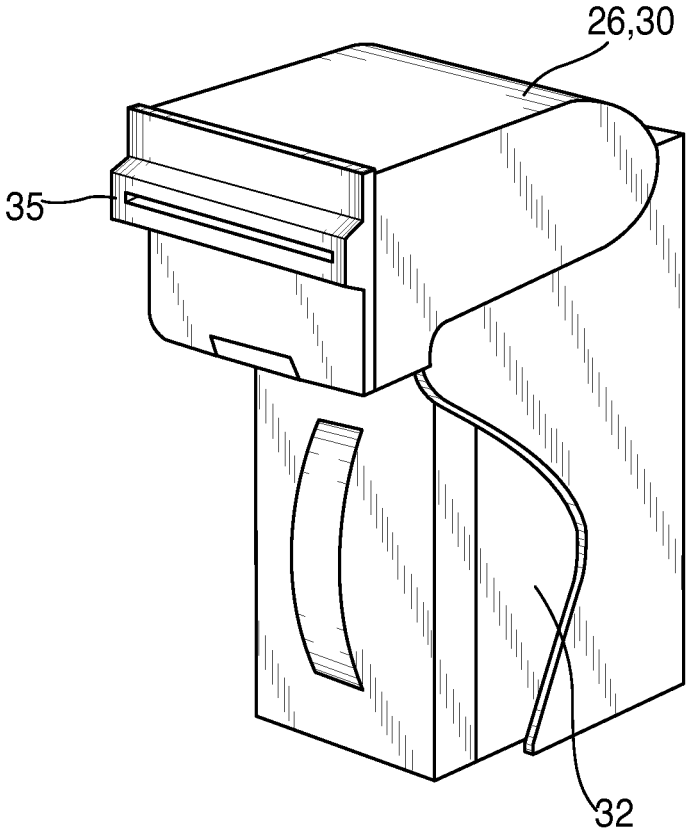
FIG. 3 PRIOR ART
FIG. 3 is a perspective view of a bill validator and currency compartment according to an embodiment of the present invention.

Referring now to FIG. 2, the drop safe 10 is shown with the door 16 in an open position revealing the interior chamber 14. Housed in the interior chamber 14 is a computing means 24, at least one bill validator 26 and a network module 28. Preferably, an optical code reader 30 and a currency compartment 32 are integrated into the bill validator 26. Good results have been obtained with integrated bill validators manufactured by MEI (Mars Electronic Incorporated, Dallas, Tex., U.S.A.), which is shown in FIG. 3. More than one bill validator may be provided with the drop safe 10 to provide redundancy, increased paper currency storage capacity, and the ability to sort paper currency at source (i.e. small denominations in one bill validator and large denominations in a second bill validator). The bill validator may also be provided with a bulk note feeder to auto-feed currency into the bill validator.

Figure 4A:
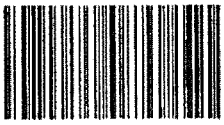
FIG. 4a PRIOR ART
FIG. 4*a* is a linear barcode encoding the word "Wikipedia" in Code 128.
Figure 4B:
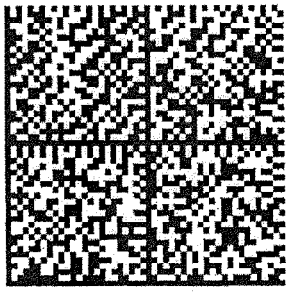
FIG. 4b PRIOR ART
FIG. 4*b* is a 2D optical code encoding Lorem ipsum boilerplate text in four segment DataMatrix 2D.
Figure 4C:
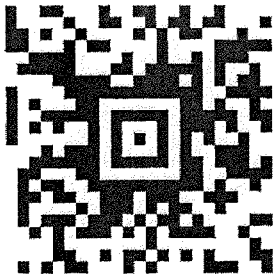
FIG. 4c PRIOR ART
FIG. 4*c* is a 2D optical code encoding the sentence "This is an example Aztec symbol for Wikipedia" in Aztec Code.
Figure 4D:
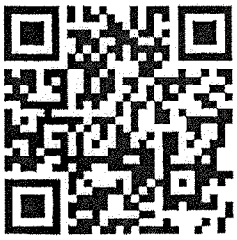
FIG. 4d PRIOR ART
FIG. 4*d* is a 2D optical code encoding the Wikipedia URL in QR Code.

The integrated bill validator 26, 30, 32 is capable of reading paper currency, having means for validating paper currency as well as for determining a denomination of the paper currency. The optical code reader 30 is capable of reading optical codes presented to it by a user. Examples of possible optical codes include linear barcodes such as the Code 128 depicted in FIG. 4*a*, or 2D matrix codes, such as those depicted in FIGS. 4*b* to 4*d*. For example, FIG. 4*b* is a 2D optical code encoding Lorem ipsum boilerplate text in four segment DataMatrix 2D. FIG. 4*c* is a 2D optical code encoding the sentence "This is an example Aztec symbol for Wikipedia" in Aztec Code. FIG. 4*d* is a 2D optical code encoding the Wikipedia URL in QR Code. The currency compartment 32, which is in communication with the bill validator 26 portion of the integrated bill validator 26, 30, 32, is capable of storing the paper currency it receives from the bill validator 26 portion of the integrated bill validator 26, 30, 32.

A slot 34 is positioned on the door 14 in alignment with the mouth 35 of the integrated bill validator 26, 30, 32 when the door 16 is in the closed position allowing a user to insert paper currency directly into the integrated bill validator 26, 30, 32 through the slot 34 when the door 16 is in the closed position and locked.

An electronic lock 36 is attached to an inside part of the door 16 as shown in FIG. 2, and is positioned to engage and disengage the handle 20. The lock 36, when activated, engages the handle 20 thereby preventing its movement, which in turn prevents withdrawal of the deadbolt 22 maintaining the door 16 secured in the closed position. The activation/deactivation of the lock 36 is controlled by the computing means 24. Preferably the lock 36 is an electromechanical solenoid-type lock which when activated moves a slug into engagement with the handle 20 to prevent it from turning. When deactivated the slug moves out of engagement with the handle 20 permitting it to turn. As mentioned above, turning the handle 20 permits withdrawal of the deadbolt 22 which maintains the door 16 secured in the closed position.

The network module 28 is configured to connect the computing means 24 to a remote computer 11 such as a webserver, via a wired or wireless connection or link 13. Although the network module 28 is shown in FIG. 2 as being a separate component from the computing means 24, it will be appreciated by persons skilled in the art that the network module 28 may be integrated with the computing means 24, so that both the computing means 24 and the network module 28 will for example reside on the same circuit board.

The computing means 24 includes a programmable microprocessor programmed to function as a central processing unit (CPU). The computing means 24 also includes a memory for storing the microprocessor operating program for the drop safe 10, and particulars of deposits into and withdrawals out of the drop safe 10, as well as other information collected. As well the computing means 24 includes connectors for input and output. The computing means is operatively connected to the integrated bill validator 26, 30, 32, the lock 36, and the network module 28.

The remote computer 11 is preferably a webserver, a computer, or any other platform that can be used to operate interactive software which can be accessed via a web site through the internet. The remote computer 11 can be housed in a secure area of the business establishment, or off site at the premises of a third party. Storage space and computing resources of a remote computer 11 operated by a third party may also be rented from the third party. As will be more clear later, the drop safe 10 is preferably a web-enabled cash deposit safe that is used by cashiers in a retail store. Each safe is preferably connected to, and communicates with, the remote computer 11 in real time. Furthermore, in some embodiments of the invention the remote computer 11 may be set up to centrally manage and control retail store operations including till creation, balancing, bank deposits, change orders and reporting. Thus the remote computer 11 may be important for centralizing information collected from a large number of drop safes located in a number of retail outlets.

Preferably, the drop safe 10 will also include a signal means for emitting either an auditory or visual signal, alerting the user to one or more specific conditions of the drop safe. The signal means will also be operatively connected to, and controlled by, the computing means 24. Examples of preferred signal means include sound emitting devices such as a speaker 38, and light emitting devices such as a bulb or light emitting diode (LED) 40. A speaker 38 for example may be integrated with the computing means 24, and/or an LED 40 may be provided on the vault door, or any part of the exterior of the drop safe 10 visible by a user in the ordinary course.

As will be appreciated by persons skilled in the art, the vault is preferably built using materials and construction techniques to make it burglar proof and optionally fireproof. Accordingly, the vault will preferably be built of, or lined, with steel. However, other materials may also be found to be adequate. Suitable safes have been obtained from Armor Safe Technologies, The Colony, Texas, U.S.A.

Having described a preferred embodiment of the drop safe 10 according to the present invention, its operation will now be described.

Figure 5:
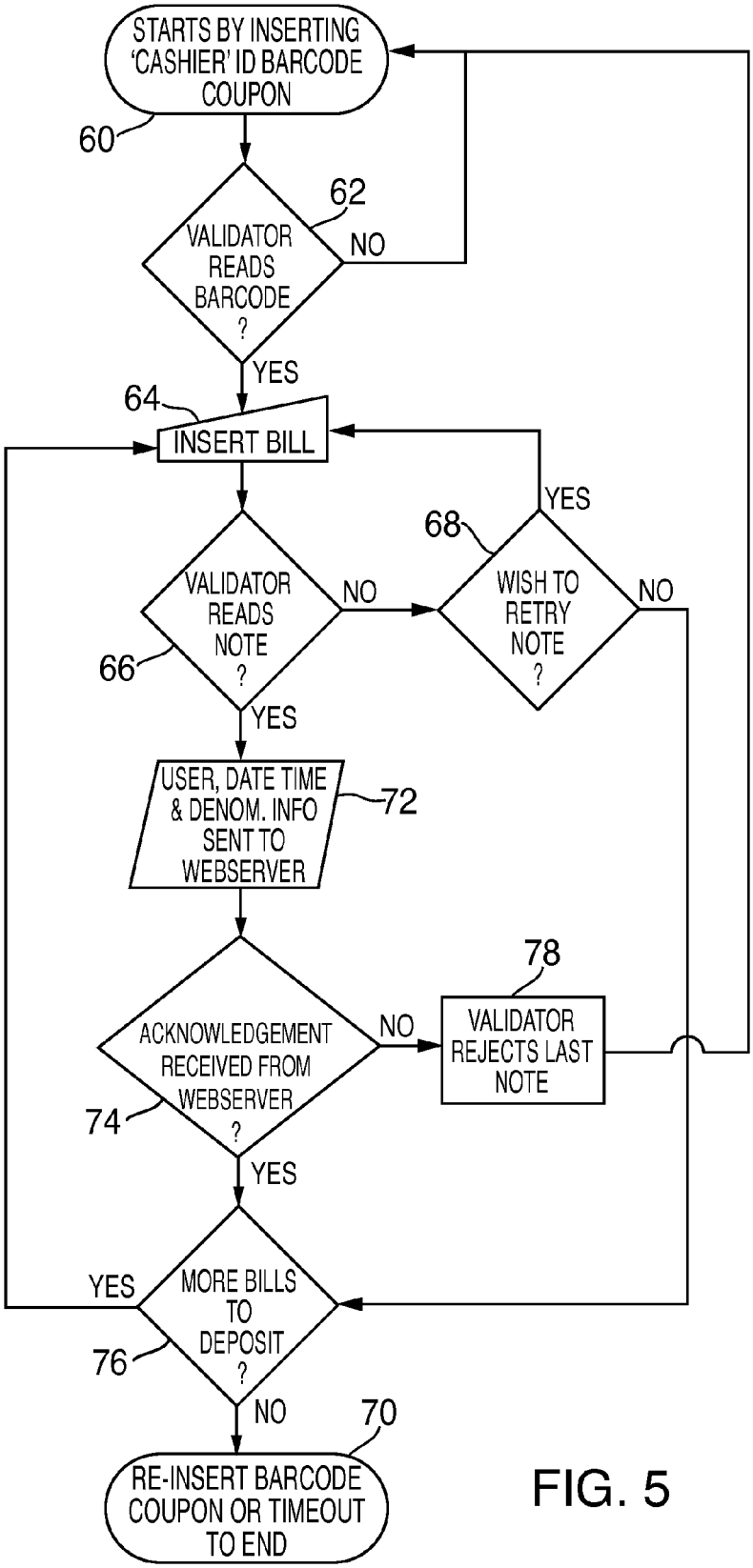
FIG. 5 is a flow chart showing the steps in a method of depositing paper currency into a drop safe in a default deposit process according to another embodiment of the present invention.

Referring now to the flow chart in FIG. 5, the steps of the default deposit process for making a deposit into the drop safe 10 will be described.

At step 60 a user, typically a cashier, will find the drop safe 10 in an idle mode in which the computing means 24 is set to receive information from the optical code reader 30 part of the integrated bill validator 26, 30, 32, when a coupon 42 containing an optical code representing a deposit initiation code, is presented thereto. The coupon 42 is preferably a sheet of paper, cardboard, film, plastic, or fiber sheets, with the optical code printed thereon. The deposit initiation code is preferably a personnel identifier (i.e. an employee number) unique to the user, in this case the cashier, who initiated, and is responsible for, the deposits.

Figure 6:
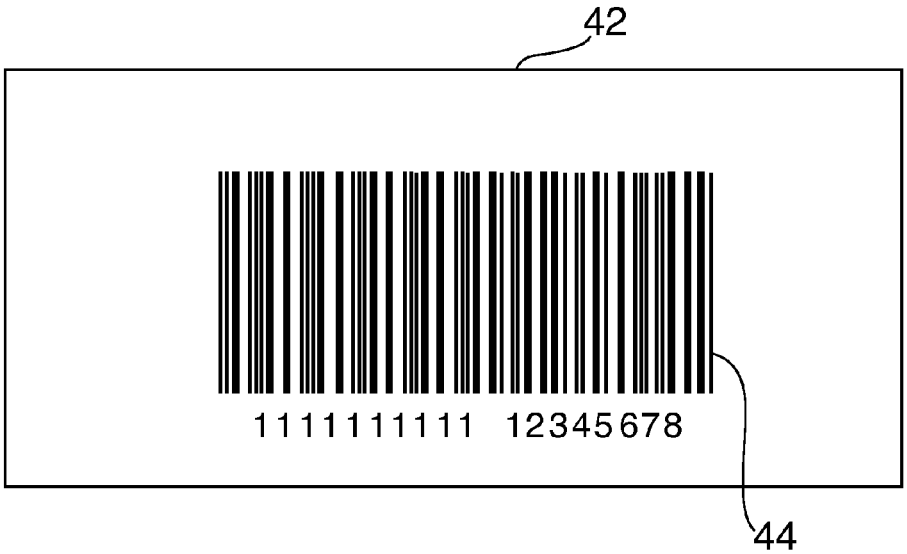
FIG. 6 is front view of a coupon containing an imprint of a barcode according to an embodiment of the present invention.

Accordingly, a user starts a deposit taking process by inserting a coupon 42, such as the one shown for example in FIG. 6, into the integrated bill validator 26, 30, 32, through slot 34 in vault door 16. Preferably the coupon 42 contains an optical code, most preferably a barcode 44, representing the deposit initiation code. As discussed in more detail below, when the deposit taking process is initiated, the computing means 24 switches from the idle mode to the deposit taking mode. While in the deposit taking mode, the computing means 24 monitors the bill validator 26 and the optical code reader 30 parts of the integrated bill validator 26, 30, 32 for (a) detection of a deposit of a valid paper currency in the bill validator 26, (b) detection of a deposit termination code by the optical code reader 30, and (c) a time-out condition.

At step 62, the integrated bill validator 26, 30, 32 will attempt to read the barcode on the coupon 42 with the optical reader 30 and send the information to the computing means 24. If the computing means fails to recognize the barcode 44, because the integrated bill validator 26, 30, 32 misreads the coupon 42, the barcode 44 code is invalid, or the barcode 44 does not contain the deposit initiation code, the computing means 24 will cause the integrated bill validator 26, 30, 32 to eject the coupon 42. Preferably, the computing means 24 will also cause the signal means to issue an alert indicating to the user that the coupon 42 was not accepted. In any event the user will be forced back to step 60 in the flow chart.

On the other hand, if at step 62 the computing means 24 detects via the optical code reader part 30 of the integrated bill validator 26, 30, 32 the deposit initiation code, then the computing means 24 will switch from the idle mode to a deposit taking mode. Preferably the user will be alerted to this by the computing means 24 causing the integrated bill validator 26, 30, 32 to eject the coupon 42 together with the signal means issuing an alert indicating to the user that the coupon 42 was accepted, and that the computing means is in the deposit taking mode, permitting the user to progress to step 64. Preferably, the computing means 24 will alert the user through the speaker 38 by issuing the message "Transaction Started" or the like. Optionally, the computing means 24 may be programmed to transmit the deposit initiation code to the remote computer 11 for verification in real time. This enables an operator to disable a cashier's code instantly before allowing the computing means 24 to switch to the deposit taking mode. However, since the deposit initiation code merely grants the cashier the ability to deposit paper currency, and not to withdraw, paper currency it is not critical to cancel a cashier's deposit initiation code in the event that the cashier's coupon 42 is lost or stolen. In any event if the cashier's coupon 42 is lost or stolen, the cashier's deposit initiation code can be instantly disallowed by the remote computer 11.

At step 64, the user inserts a first paper currency into the mouth 35 of the integrated bill validator 26, 30, 32.

At step 66, the integrated bill validator 26, 30, 32 will attempt to read the paper currency with the bill validator part 26 to obtain information on its validity, and denomination, and send the information to the computing means 24. If the bill validator part 26 detects an invalid paper currency, or fails to read the paper currency for whatever reason, the computing means 24 will cause the integrated bill validator 26, 30, 32 to eject the paper currency, which will signal to the user that the paper currency was not deposited. Optionally the rejection of the paper currency may be accompanied by an alert from the signal means.

In any event, the user will have an option at step 68 to retry depositing the paper currency at step 64, depositing another paper currency at step 76, or ending the deposit process at step 70 by inserting a coupon 42 containing a barcode 44, representing a deposit termination code into the mouth 30 of the integrated bill validator 26, 30, 32, which when detected will cause the computing means 24 to switch back to the idle mode in step 60. Preferably, the deposit initiation code is the same as the deposit termination code, meaning that the same coupon 42 can be used to start and end the deposit process. However, it is also contemplated that the deposit initiation code and the deposit termination code may be different. At step 70, the user will also have the option of doing nothing, in which case the computing means 24 will detect a time-out condition after a predetermined amount of time has elapsed and neither a paper currency is inserted into the bill validator 26, nor a coupon 44 containing the deposit termination code is detected by the optical code reader 20. The consequence of the computing means 24 detecting the time-out condition, will also be the computing means 24 switching from the deposit taking mode back to the idle mode. The period of time before a time-out condition is detected can be any time, however, good results have been obtained with the period of time being set to at least 5 seconds, and preferably between 10 and 30 seconds.

If at step 66 the bill validator 26 read the paper currency, validated it, and determined its denomination, the computing means 24 would at step 72 transmit particulars of the deposit to the remote computer 11 via the wired or wireless link 13. Preferably, the particulars of the deposit will be transmitted by the computing means 24 through the internet via the network module 28. The particulars of the deposit may include one or more of a safe identifier or a safe location number, a date of the deposit, a time of the deposit, the deposit initiation code, the deposit termination code, a personnel identifier, etc.

After the particulars of the deposit are transmitted to the remote computer 11 at step 72, the computing means 24 waits at step 74 for a predetermined period of time for a signal from the remote computer 11 confirming or acknowledging that the particulars were received and recorded. If the signal is received the computing means 24 accepts the paper currency and directs the bill validator 26 to transfer the valid paper currency to the currency compartment 32 via a transfer means preferably integrated with the integrated bill validator 26, 30, 32. Preferably, every time the computing means 24 accepts the paper currency and directs the bill validator 26 to transfer the valid paper currency to the currency compartment 32 it will alert the user by stating the denomination of the accepted paper currency via speaker 38. These verification steps occur in real time and are typically instantaneous. The computing means 24 also permits the user at step 76 to either proceed to step 64 to deposit another paper currency which maintains the computing means 24 in the deposit taking mode, or to end the deposit taking mode by inserting the coupon 42 containing the deposit termination code at step 70, causing the computing means 24 to return to the idle mode at step 60. Preferably, the computing means 24 will also issue an auditory alert through speaker 38 stating "Transaction Ended" followed by an indication of the total of the accepted deposits (i.e. "Deposit totals $5").

At step 70, the user will also have the option of doing nothing, in which case the computing means 24 will detect a time-out condition after a predetermined amount of time has elapsed and neither a paper currency is inserted into the bill validator 26, nor a coupon 44 containing the deposit termination code is detected by the optical code reader 20. The consequence of the computing means 24 detecting the time-out condition, will also be the computing means 24 switching from the deposit taking mode back to the idle mode. Preferably, the computing means 24 will also issue an auditory alert through speaker 38 stating "Transaction Ended" followed by an indication of the total of the accepted deposits (i.e. "Deposit totals $5"). The period of time before a time-out condition is detected can be any time, however, good results have been obtained with the period of time being set to at least 5 seconds, and preferably between 10 and 30 seconds, as mentioned above.

The drop safe 10 preferably also comprises a memory means associated with the computing means 24 which is adapted to record and store the particulars of the deposit locally.

However, if no acknowledgement or confirmation of recordal of the particulars of the deposit is received from the remote computer 11 at step 74, the computing means 24 will cause the bill validator to reject the last paper currency at step 78 and terminate the deposit taking mode and revert to the idle mode in step 60. The rejection of the last paper currency will preferably be accompanied by either an aural or visual alert from the signal means. Preferably, the alert is an aural alert through speaker 38 stating "Transaction Ended" followed by an indication of the total of the accepted deposits (i.e. "Deposit totals $5").

The likely reason for a failure to receive acknowledgment or confirmation of recordal of particulars of the deposit from the remote computer 11 at step 74 will be that the wired or wireless link 13 with the remote computer 11 has been temporarily lost. Essentially this will mean that the drop safe 10 is temporarily out of order.

The computing means 24 preferably keeps track of the number of consecutive times acknowledgement was not received from the remote computer 11 at step 74. Once a certain limit is reached, for example 5, the computing means 24 will follow a batch deposit process for making a deposit into the drop safe 10, which is outlined in FIG. 6. The batch deposit process is intended for use in cases where the wired or wireless connection to the remote computer 11 is temporarily interrupted, or where a continuous link 13 is impractical or unreliable.

The batch deposit process, records and stores particulars of all deposits occurring in a time span of minutes, to hours, days weeks and even longer, locally, and transmits the recorded particulars of all of the deposits to the remote computer 11 at once, when a reliable wired or wireless connection with the remote computer 11 is established.

Figure 7:
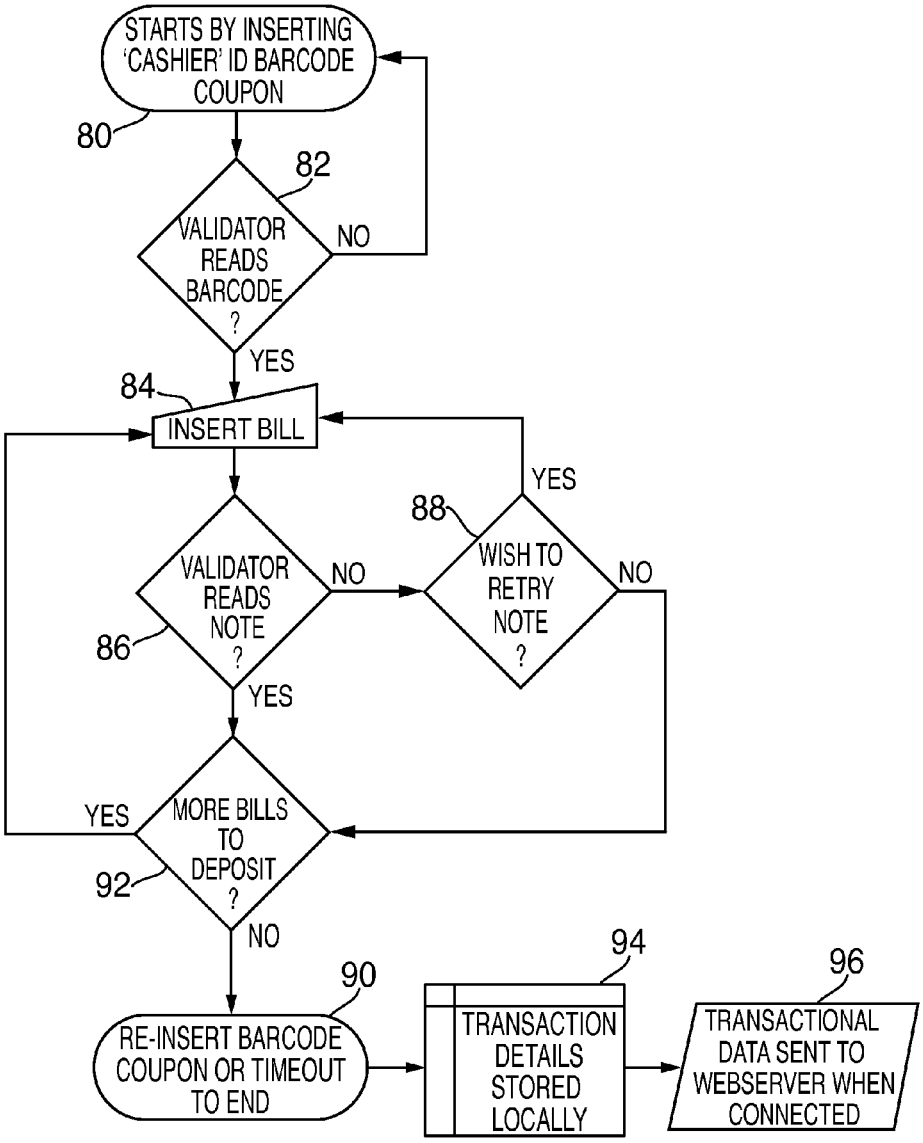
FIG. 7 is a flow chart showing the steps in a method of depositing paper currency into a drop safe in a batch deposit process according to another embodiment of the present invention.

Referring now to the flow chart in FIG. 7, the steps of the batch deposit process will now be described.

As in the case of the default deposit process, the cashier will find the drop safe 10 in an idle mode at step 80. The user starts the deposit taking process by inserting a coupon 42, into the integrated bill validator 26, 30, 32, through slot 34 in vault door 16, as before.

At step 82, the integrated bill validator 26, 30, 32 will attempt to read the barcode on the coupon 42 with the optical reader 30 and send the information to the computing means 24. If the computing means fails to recognize the barcode 44, the computing means 24 will cause the integrated bill validator 26, 30, 32 to eject the coupon 42. Preferably, the computing means 24 will also cause the signal means to issue an alert indicating to the user that the coupon 42 was not accepted. In any event the user will be forced back to step 80 in the flow chart. That is the computing means 24 will remain in the idle mode.

On the other hand, if at step 82 the computing means 24 detects the deposit initiation code via the optical code reader part 30, then the computing means 24 will switch from the idle mode to the deposit taking mode. Preferably the user will be alerted to this by the computing means 24 causing the integrated bill validator 26, 30, 32 to eject the coupon 42 accompanied by the signal means issuing an alert. Preferably, the computing means 24 alerts the user through the speaker 38 by issuing the message "Transaction Started" or the like. The user will then be permitted to progress to step 84.

At step 84, the user inserts the first paper currency into the mouth 35 of the integrated bill validator 26, 30, 32.

At step 86, the integrated bill validator 26, 30, 32 will attempt to read the paper currency with the bill validator part 26 to obtain information with respect to its denomination and validity, and send the information to the computing means 24. If the bill validator part 26 detects an invalid paper currency, or fails to read the paper currency for whatever reason, the computing means 24 will cause the integrated bill validator 26, 30, 32 to eject the paper currency, which will signal to the user that the paper currency was not deposited. Optionally the rejection of the paper currency may be accompanied by an alert from the signal means.

In any event, the user will have an option at step 88 to retry depositing the paper currency at step 84, depositing another paper currency at step 92, or ending the deposit process at step 90 by inserting a coupon 42 containing a barcode 44, representing a deposit termination code into the mouth 30 of the integrated bill validator 26, 30, 32, which when detected will cause the computing means 24 to switch back to the idle mode in step 80. As discussed above, the deposit initiation code is preferably the same as the deposit termination code, meaning that the same coupon 42 can be used to start and end the deposit process. However, it is also contemplated that the deposit initiation code and the deposit termination code may be different. At step 90, the user will also have the option of doing nothing, in which case the computing means 24 will detect a time-out condition after a predetermined amount of time has elapsed and neither a paper currency is inserted into the bill validator 26, nor a coupon 44 containing the deposit termination code is detected by the optical code reader 20. The consequence of the computing means 24 detecting the time-out condition, will also be the computing means 24 switching from the deposit taking mode back to the idle mode. The period of time before a time-out condition is detected can be any time, however, good results have been obtained with the period of time being set to at least 5 seconds, and preferably between 10 and 30 seconds.

If at step 86 the bill validator 26 reads the paper currency, validates it, and determines its denomination, the computing means 24 will preferably record the particulars locally in a memory means associated with the computing means 24 which is adapted to record and store the particulars of the deposit locally. After the particulars of the deposit are recorded locally, the computing means 24 preferably waits at step 86 for a predetermined period of time for a signal from the memory means confirming or acknowledging that the particulars were recorded. If the signal is received the computing means 24 accepts the paper currency and directs the bill validator 26 to transfer the valid paper currency to the currency compartment 32 via the transfer means preferably integrated with the integrated bill validator 26, 30, 32. Preferably, every time the computing means 24 accepts the paper currency and directs the bill validator 26 to transfer the valid paper currency to the currency compartment 32 it will alert the user by stating the denomination of the accepted paper currency via speaker 38.

The computing means 24 also permits the user at step 92 to either proceed to step 84 to deposit another paper currency which maintains the computing means 24 in the deposit taking mode, or to end the deposit taking mode by inserting the coupon 42 containing the deposit termination code at step 90, causing the computing means 24 to return to the idle mode at step 70. Preferably, the computing means 24 will also issue an auditory alert through speaker 38 stating "Transaction Ended" followed by an indication of the total of the accepted deposits (i.e. "Deposit totals $5").

At step 90, the user will also have the option of doing nothing, in which case the computing means 24 will detect a time-out condition after a predetermined amount of time has elapsed, as mentioned above. However, before the computing means 24 reverts back to the idle mode at step 80, the computing means 24 preferably stores the particulars of the last deposit locally at step 94, and if a reliable wired or wireless connection to the remote computer 11 is established, the computing means 24 transmits the whole batch of stored particulars to the remote computer 11 at once in step 96. The computing means may also be set to transmit the stored particulars to the remote computer 11 at one or more predetermined timers or when one or more predetermined parameters are met, and a wired or wireless link 13 to the remote computer 11 is present.

Figure 8:
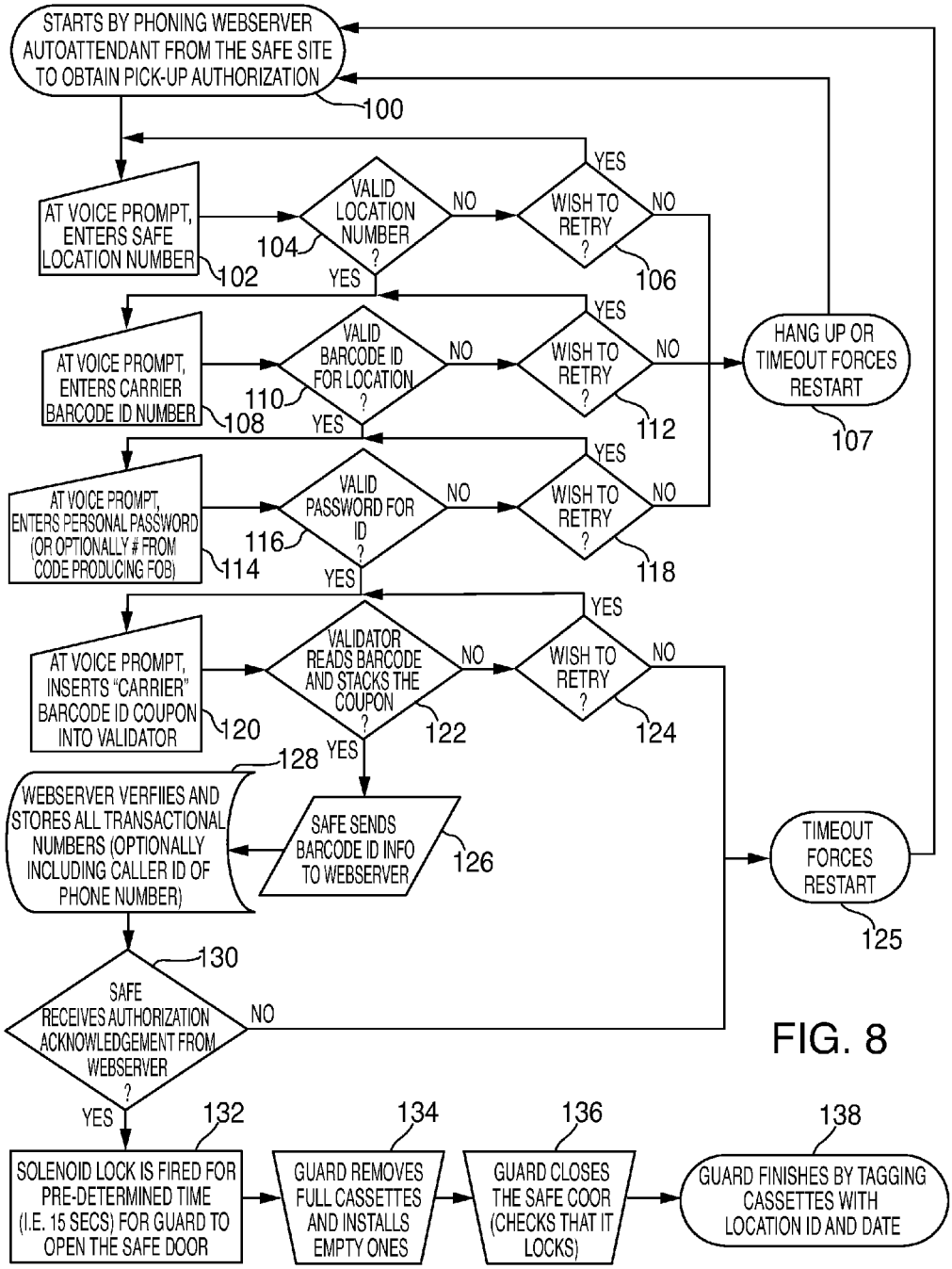
FIG. 8 is a flow chart showing the steps in a method of removing cash from a drop safe according to an embodiment of the present invention.

The flow chart in FIG. 8, shows the steps of a method of removing paper currency from the drop safe 10 according to the present invention. It is contemplated that the paper currency stored in the currency compartment(s) 32 in the drop safe 10 will be removed and collected by an armed guard or carrier and transferred to a bank for safe keeping on behalf of the owner of the business establishment. Accordingly, the following describes how a carrier interacts with the drop safe 10 to remove paper currency from the currency compartment 32. However, the drop safe 10 need not be used with an armed guard or carrier service, as the business owner may be assigned access, or the business owner may designate another to obtain access to the drop safe 10.

As will be clear, the carrier provides pickup request information to the remote computer 11 in response to prompts from the autoattendant, and verifies the information by comparing it against records stored in the remote computer 11. Preferably the pickup request information collected by the remote computer 11 includes one or more of a safe serial number, a safe location number, a carrier identification number, a password, and numbers or letters printed on a coupon 42 (i.e. last 3 digits on the coupon) which the carrier will insert into the drop safe 10 at the appropriate time as discussed more fully below.

Accordingly, at step 100, the carrier arrives at the business establishment or safe site where the drop safe 10 is located based on a pre-arranged schedule, or on receiving an indication from the remote computer 11 that the currency compartment 32 is full. Once at the safe's location the carrier places a telephone call to the remote computer 11 and interacts with the remote computer 11 autoattendant to obtain pick-up authorization.

The autoattendent produces a voice prompt at step 102 requesting the carrier to enter a safe identifier or safe location number (i.e. "Please enter safe serial number followed by the # sign"). This may be a unique number assigned to a particular drop safe 10 or associated with a location of the drop safe 10. The carrier enters the number using the keypad on the telephone and at step 104 the remote computer 11 compares the carrier's entry against its database to determine whether the entry is a valid safe identifier or location number. If not, the carrier will be so informed and the autoattendant will ask the carrier at step 106 whether he wishes to re-enter the safe identifier or location number. If the carrier selects the option to re-enter the safe identifier or location number he will move back to step 102. If the carrier selects the option to not re-enter the safe location number the autoattendant will hang up and the computing means 24 will return to idle mode at step 107. The auto attendant will also hang up it fails to receive any response from the carrier in a predetermined period of time. The carrier can also choose to hang up the telephone at any time.

However, if at step 104 the carrier enters a valid safe identifier or location number the autoattendant will produce a voice prompt requesting the carrier to enter his carrier identifier number (i.e. employee number or other number associated with the carrier) at step 108. For example the voice prompt may be the phrase "Please enter your employee identification number followed by the # sign". The carrier enters the carrier identifier number using the keypad on the telephone and at step 110 the remote computer 11 compares the carrier's entry against its database to determine whether the entry is a valid carrier identifier number based on the safe identifier or location number. If not, the carrier will be so informed and the autoattendant will ask the carrier at step 112 whether he wishes to re-enter the safe location number. If the carrier selects the option to re-enter the carrier identification number he will move back to step 108. If the carrier selects the option to not re-enter the safe location number the autoattendant will hang up and the computing means 24 will return to idle mode at step 107. The auto attendant will also hang up it fails to receive any response from the carrier in a predetermined period of time. The carrier can also choose to hang up the telephone at any time.

However, if at step 110 the carrier enters a valid carrier identification number the autoattendant will produce a voice prompt requesting the carrier to enter his personal password at step 114 (i.e. "Please enter password followed by the # sign"). The carrier enters the password using the keypad on the telephone and at step 116 the remote computer 11 compares the carrier's entry against its database to determine whether the entry is a valid password. If not, the carrier will be so informed and the autoattendant will ask the carrier at step 118 whether he wishes to re-enter the password. If the carrier selects the option to re-enter the carrier identification number he will move back to step 114. If the carrier selects the option to not re-enter the safe location number the autoattendant will hang up and the computing means 24 will return to idle mode at step 107. The autoattendant will also hang up it fails to receive any response from the carrier in a predetermined period of time. The carrier can also choose to hang up the telephone at any time.

If at step 116 the carrier enters a valid personal password the autoattendant will at step 120 instruct the carrier to proceed to the drop safe 10 and present a coupon 42 to the optical code reader 30 part of the integrated bill validator 26, 30, 32, and hang up. At the drop safe 10, the carrier present the coupon 42 containing a printed barcode representing one piece of the pickup request information, such as for example the carrier identification number, to the optical code reader 30 part of the integrated bill validator 26, 30, 32. Preferably, the integrated bill validator 26, 30, 32 will receive the coupon 42 and at step 122 it will read the barcode 44. If the integrated bill validator 26, 30, 32 fails to read the barcode 44, the carrier will be so informed, the coupon 42 will be ejected, and the signal means will issue an alert, such as an aural alert, ask the carrier at step 124 to re-try the coupon 42 or another coupon. If the carrier selects the option to re-try the coupon or another coupon he will move back to step 120. If the carrier selects the option to not re-try the coupon 44 the computing means 24 will return to idle mode at step 125 after a predetermined timeout period expires.

However, if at step 122 the integrated bill validator 26, 30, 32 reads the barcode 44, it will transfer the coupon 42 to the currency compartment 32 via the transfer means and at step 126 the computing means 24 will transmit the barcode to the remote computer 11 via the network module 28. The remote computer 11 checks that the barcode represents a valid piece of the pickup request information, preferably the carrier identifier number, and if so verifies and stores at step 128 all of the pickup request information, preferably including caller ID information of the phone call by the carrier when calling into the remote computer 11 telephone autoattendant.

If the remote computer 11 determines that the pickup request information is not valid at step 130, and the computing means 24 will return to idle mode at step 125. Preferably, the signal means will issue an aural alert via the speaker 38 apprising the carrier of this. The computing means 24 will also return to idle mode if it fails to receive a signal from the remote computer 11 to deactivate the electronic lock in a predetermined period of time.

However, if the remote computer 11 determines that the pickup request information is valid at step 130 it will send a signal to the computing means 24 at step 132 to deactivate the electronic lock 36. Preferably, as mentioned above, the lock 36 is an electromechanical solenoid-type lock which when deactivated the slug is moved out of engagement with the handle 20 permitting it to turn. The deactivation of the lock 36 may be accompanied by an alert from the signal means (i.e. "Safe Unlocked"). Preferably, the lock is disengaged for a predetermined amount of time such as 5 to 30 seconds. When the carrier hears or sees the alert, or hears the lock 36 being disengaged he will turn the handle 20 to withdraw the deadbolt 22, and open the door 16.

Once the door 16 is opened, the carrier will at step 134 remove the currency compartment 30 containing paper currency, and preferably replace it with an empty currency compartment. However, it is also contemplated that the carrier may remove the paper currency from the currency compartment 30 and reuse the now empty currency compartment 30 in the integrated bill validator 26, 30, 32.

Next the carrier will, at step 136, close the vault door 16, turn the handle until the slug of the lock 26 engages the handle 20 and the deadbolt 22 is extended to maintain the door 16 secured in the closed position.

The carrier finishes up at step 138 by tagging the retrieved currency compartment 30 with site location and date information as will be known to persons skilled in the art.

As will now be understood, to gain access to the interior chamber 14 of the drop safe 10, via the door 16, the carrier first provides pickup request information to the remote computer 11 in response to voice prompts by the autoattendant. The pickup request information can include one or more of a drop safe location number, a carrier identifier, and a password. The remote computer 11 validates the pickup request information and the autoattendant prompts the carrier to present a code representing at least one piece of the pickup request information to a code reader on the drop safe 10, which in the above example is an optical barcode reader. The remote computer 11 validates the pickup request information code and sends a signal to the computing means to deactivate the electronic lock. When the electronic lock is deactivated by the computing means 24 in response to the signal from the remote computer 11, the carrier can open the vault door 16 and remove the paper currency from the currency compartment 30.

According to another embodiment of the present invention the carrier will be asked by the autoattendent at step 114 for a code associated with his personal RFID tag in place of a personal password, and at step 120 the carrier will be prompted to present his personal RFID tag to be read at step 122 by an RFID tag reader associated with the bill validator 26 or separate from the RFID tag reader.

While reference has been made to various preferred embodiments of the invention other variations, implementations, modifications, alterations and embodiments are comprehended by the broad scope of the appended claims. Some of these have been discussed in detail in this specification and others will be apparent to those skilled in the art. Those of ordinary skill in the art having access to the teachings herein will recognize these additional variations, implementations, modifications, alterations and embodiments, all of which are within the scope of the present invention and intended to be covered by the appended claims, without limitation.

Figure 9:
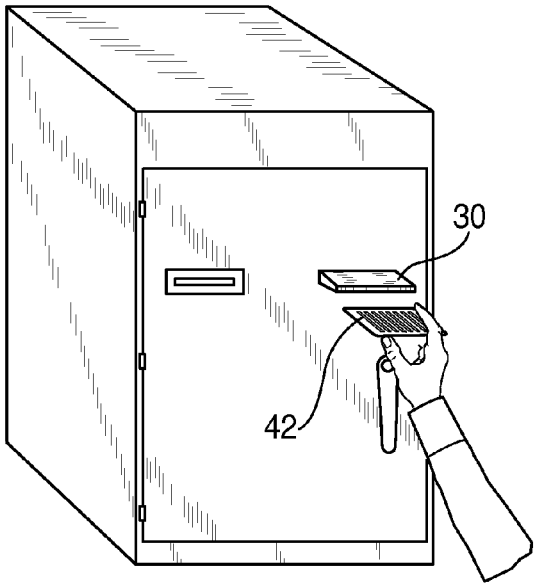
FIG. 9 is a perspective view of a drop safe according to another embodiment of the present invention showing a user presenting an optical code on a printed sheet to an optical code reader positioned on the vault door separate from the bill validator.
Figure 10:
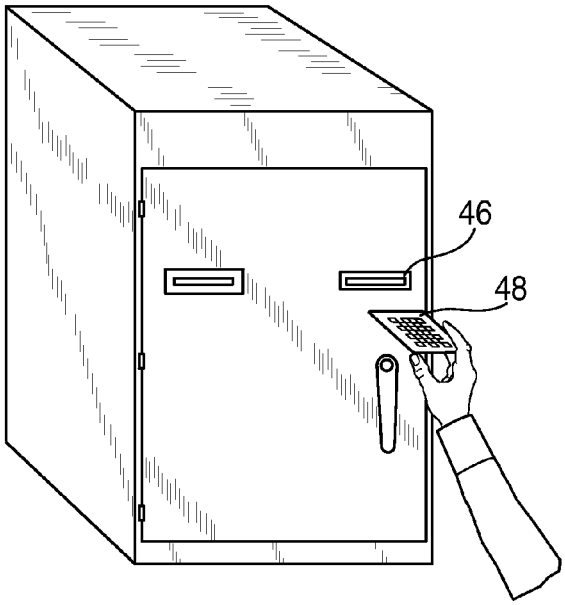
FIG. 10 is a perspective view of a drop safe according to another embodiment of the present invention showing a user presenting a smart card code on a smart card to a smart card reader positioned on the vault door separate from the bill validator.
Figure 11:
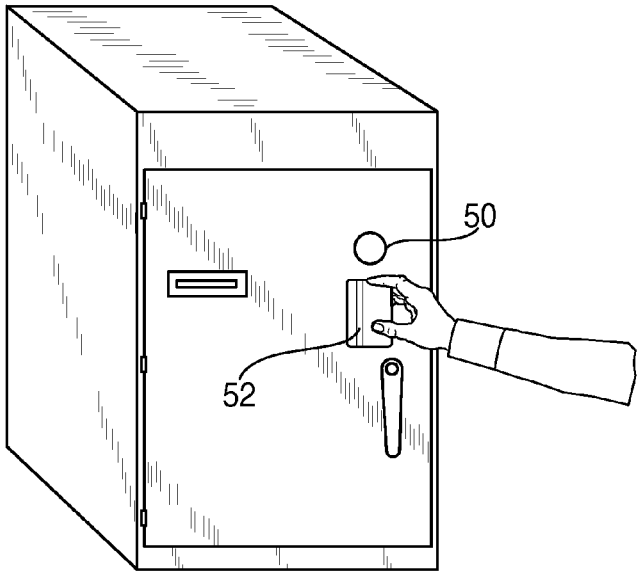
FIG. 11 is a perspective view of a drop safe according to yet another embodiment of the present invention showing a user presenting a RFID code on a RFID tag to a RFID tag reader positioned on the vault door separate from the bill validator.
Figure 12:
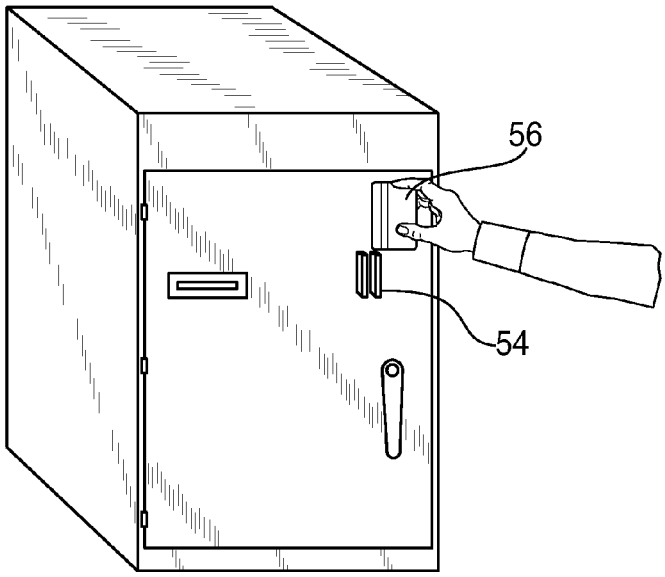
FIG. 12 is a perspective view of a drop safe according to yet another embodiment of the present invention showing a user presenting a magnetic code on a magnetic strip to a magnetic strip reader positioned on the vault door separate from the bill validator.

For example, the optical code reader 30 may be separate from the bill validator 26, as shown in FIG. 9. Also, the optical code reader may be replaced by another code reader, such as for example a smart card reader 46 for reading smart card codes 48, as shown in FIG. 10. A smart card, also known as a chip card or integrated circuit card (ICC), is any pocket-sized card with embedded integrated circuits. There are two broad categories of ICCs, memory cards containing only non-volatile memory storage components, and perhaps dedicated security logic, and microprocessor cards containing volatile memory and microprocessor components. A drop safe 10 with a radio frequency identification (RFID) tag reader 50 for reading RFID codes 52 is shown in FIG. 11. A drop safe 10 with a magnetic strip reader 54 for reading magnetic codes 56, as shown in FIG. 12.

Other code readers are contemplated as well, all of which may be integrated with the bill validator 26 or separate from the bill validator 26. For example, the drop safe 10 may be provided with a biometric code reader for reading biometric codes. Examples of biometric code readers include retina scanners, iris scanners, and fingerprint readers.

Figure 13:
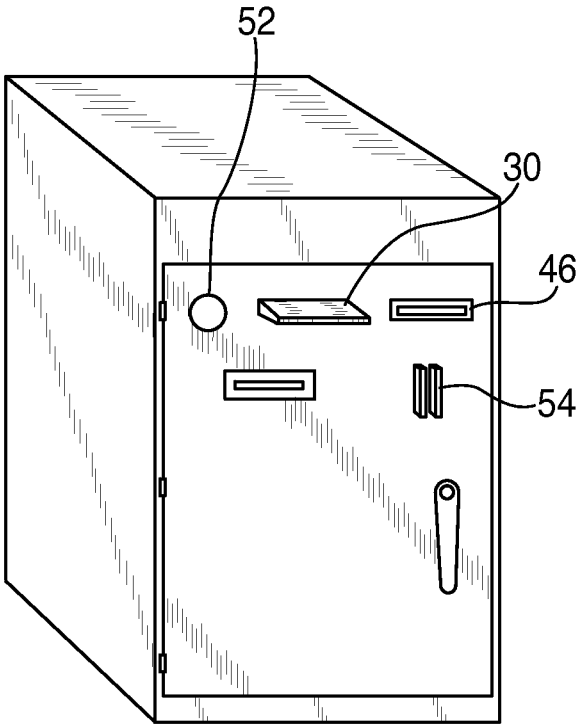
FIG. 13 is a perspective view of a drop safe according to yet another embodiment of the present invention having a RFID tag reader, an optical reader, a smart card reader, and a magnetic strip reader positioned on the vault door separate from the bill validator.

It is also contemplated that more than one code reader may be included on the drop safe 10 as shown in FIG. 13, where the drop safe 10 includes a RFID tag reader 52, an optical code reader 30, a smart card reader 46, and a magnetic strip reader 54 on the vault door 16.

Furthermore, although the drop safe 10 is described above with reference to one bill validator 26 and one currency compartment 30, it will be understood that more than one bill validator 26 and currency compartments may be provided in the drop safe 10.

Furthermore, the pickup request information can include other information known only to the carrier, such as for example a specific sequence of numbers and/or letters on the coupon 42. Accordingly, the autoattendant may be programmed to include one or more further prompts for further pickup request information (i.e. "Please enter the last three digits on the pickup ticket").

Furthermore, the drop safe 10 may optionally include a printer for printing receipts containing a summary of the deposit.

The invention claimed is:

1. A drop safe comprising:

a vault;

a computing means located inside said vault, said computing means being operatively connected to at least one bill validator for reading paper currency, and a code reader for reading codes;

a currency compartment located inside said vault for storing paper currency, said currency compartment being in communication with said bill validator;

said bill validator having a means for validating, and determining a denomination of, paper currency; and said computing means initially being in an idle mode and configured to switch between said idle mode and a deposit taking mode;

wherein, upon said code reader detecting a deposit initiation code identifying a user, the computing means switches from said idle mode to said deposit taking mode to enable the bill validator to accept the paper currency without requiring additional control input from the user, and upon said code reader detecting a deposit termination code, the computing means switches from said deposit taking mode back to said idle mode.

2. The drop safe as claimed in claim 1, wherein said vault comprises a vault door.

3. The drop safe as claimed in claim 2, further comprising an electronic lock for securing said vault door in a closed position, said electronic lock being activatable and deactivatable by said computing means.

4. The drop safe as claimed in claim 1, wherein said deposit initiation code and/or said deposit termination code comprises a personnel identifier.

5. The drop safe as claimed in claim 1, wherein said deposit initiation code is the same as said deposit termination code.

6. The drop safe as claimed in claim 1, wherein said deposit initiation code is different from said deposit termination code.

7. The drop safe as claimed in claim 1, wherein when said computing means is in said deposit taking mode, and said computing means detects a time-out condition said computing means switches from said deposit taking mode back to said idle mode.

8. The drop safe as claimed in claim 7, wherein said time-out condition is a period of time during which the bill validator fails to detect said deposit, and the code reader fails to detect said deposit termination code.

9. The drop safe as claimed in claim 8, wherein said period of time is at least 5 seconds.

10. The drop safe as claimed in claim 9, wherein said period of time is between 10 seconds and 30 seconds.

11. The drop safe as claimed in claim 1, wherein said code reader is integrated with said bill validator.

12. The drop safe as claimed in claim 1, wherein said code reader is separate from said bill validator.

13. The drop safe as claimed in claim 1, wherein said code reader is a radio frequency identification (RFID) tag reader for reading RFID codes, a smart card reader for reading smart card codes, a magnetic strip reader for reading magnetic codes, an optical reader for reading optical codes, or a biometric code reader for reading biometric codes.

14. The drop safe as claimed in claim 13, wherein said code reader is said optical reader for reading optical codes.

15. The drop safe as claimed in claim 14, wherein said optical reader is configured to read said optical codes from printed sheets.

16. The drop safe as claimed in claim 15, wherein said printed sheets comprise paper, cardboard, film, plastic, or fiber sheets.

17. The drop safe as claimed in claim 15, wherein said optical codes comprise barcodes or 2d matrix codes.

18. The drop safe as claimed in claim 17, wherein said barcodes comprise linear barcodes.

19. The drop safe as claimed in claim 1, wherein when said computing means switches to said deposit taking mode, said computing means monitors said bill validator and said code reader for (a) detection of a deposit of a valid paper currency in said bill validator, (b) detection of a deposit termination code by said code reader, and (c) a time-out condition.

20. The drop safe as claimed in claim 19, wherein said code reader is an optical code reader and said deposit termination code is an optical code.

21. The drop safe as claimed in claim 19, wherein said detection of said deposit causes said computing means to maintain said deposit taking mode, and said detection of said deposit termination code causes said computing means to switch to said idle mode.

22. The drop safe as claimed in claim 19, further comprising a means for recording particulars of said deposit locally or remotely.

23. The drop safe as claimed in claim 22, wherein said particulars of said deposit comprise said denomination of said valid paper currency, and one or more of a date, a time of the deposit, the deposit initiation code, the deposit termination code, and a personnel identifier.

24. The drop safe as claimed in claim 23, further comprising a link between said computing means and a remote computer, said link being configured to transmit said particulars of said deposit to said remote computer.

25. The drop safe as claimed in claim 24, wherein said link comprises a wired link or a wireless link.

26. The drop safe as claimed in claim 25, wherein said wired link comprises an internet connection.

27. The drop safe as claimed in claim 24, wherein said bill validator comprises a means for transferring said valid paper currency to said currency compartment.

28. The drop safe as claimed in claim 27, wherein said computing means is configured to cause said transfer means to transfer said valid paper currency to said currency compartment in response to a signal from said remote computer acknowledging said particulars of said deposit were received by said remote computer.

29. The drop safe as claimed in claim 27, wherein said computing means is configured to cause said transfer means to transfer said valid paper currency to said currency compartment in response to a signal from said remote computer acknowledging said particulars of said deposit were validated by said remote computer.

30. The drop safe as claimed in claim 27, further comprising a memory means associated with said computing means, said memory means being adapted to record and store said particulars of said deposit.

31. The drop safe as claimed in claim 30, wherein said computing means is configured to cause said transfer means to transfer said valid paper currency to said currency compartment in response to a signal from said memory means acknowledging successful recordal of said particulars.

32. The drop safe as claimed in claim 27, wherein said computing means is set to transmit said stored particulars to said remote computer at one or more predetermined times or when one or more predetermined parameters are met.

33. The drop safe as claimed in claim 1, further comprising an electronic lock for securing said vault door in a closed position, said electronic lock being activatable and deactivatable by said computing means.

34. The drop safe as claimed in claim 33, further comprising a link between said computing means and a remote computer, wherein said link is configured to transmit a signal from said remote computer to said computing means to activate or deactivate said electronic lock.

35. The drop safe as claimed in claim 1, wherein when said computing means is in said deposit taking mode, said computing means is programmed to monitor the bill validator for detection of a deposit of a valid paper currency, the code reader for detection of a termination code, or a time-out condition, wherein detection of said termination code or said time-out condition causes the computing means to terminate said deposit taking mode and initiate said idle mode; and if the bill validator detects said deposit, said computing means is programmed to record and store the particulars of said deposit locally or remotely; and after said recordal of said particulars locally or remotely is confirmed by said computing means and/or said particulars are validated by said remote computer, said computing means is programmed to cause the bill validator to transfer said valid paper currency to said currency compartment.

36. The drop safe as claimed in claim 35, wherein said code reader is an optical code reader and said termination code is an optical code.

37. The drop safe as claimed in claim 1, further comprising a link between said computing means and a remote computer to enable said remote computer to disable said deposit initiation code to prevent said computing means from switching to said deposit taking mode.

38. A drop safe comprising:

a vault;

a computing means located inside said vault, said computing means being operatively connected to at least one bill validator for reading paper currency, and a code reader for reading codes;

a currency compartment located inside said vault for storing paper currency, said currency compartment being in communication with said bill validator;

said bill validator having a means for validating, and determining a denomination of, paper currency; and said computing means initially being in an idle mode and configured to switch between said idle mode and a deposit taking mode;

wherein, upon said code reader detecting a deposit initiation code, the computing means switches from said idle mode to said deposit taking mode and upon said code reader detecting a deposit termination code, the computing means switches from said deposit taking mode back to said idle mode; and wherein said code reader is an optical code reader and said deposit termination code is an optical code.

39. A drop safe comprising:

a vault;

a computing means located inside said vault, said computing means being operatively connected to at least one bill validator for reading paper currency, and a code reader for reading codes;

a currency compartment located inside said vault for storing paper currency, said currency compartment being in communication with said bill validator;

said bill validator having a means for validating, and determining a denomination of, paper currency, and a means for transferring valid paper currency to said currency compartment; and said computing means initially being in an idle mode and configured to switch between said idle mode and a deposit taking mode;

wherein, upon said code reader detecting a deposit initiation code, the computing means switches from said idle mode to said deposit taking mode and upon said code reader detecting a deposit termination code, the computing means switches from said deposit taking mode back to said idle mode;

wherein when said computing means switches to said deposit taking mode, said computing means monitors said bill validator and said code reader for (a) detection of a deposit of a valid paper currency in said bill validator, (b) detection of a deposit termination code by said code reader, and (c) a time-out condition; and wherein said computing means is configured to cause said transfer means to transfer said valid paper currency to said currency compartment in response to a signal from a remote computer acknowledging particulars of said deposit were received or validated by said remote computer.

* * * * *